US007316103B2

(12) United States Patent
Ford

(10) Patent No.: US 7,316,103 B2
(45) Date of Patent: Jan. 8, 2008

(54) CONTINUOUS MOTION PACKAGING SYSTEM

(75) Inventor: Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 11/446,919

(22) Filed: Jun. 5, 2006

(65) Prior Publication Data

US 2007/0277480 A1 Dec. 6, 2007

(51) Int. Cl.
*B65B 11/06* (2006.01)
*B65B 11/48* (2006.01)

(52) U.S. Cl. ..... 53/461; 53/228

(58) Field of Classification Search ..... 53/448, 53/461, 468, 228, 230, 233, 543; 198/418.7, 198/419.3
See application file for complete search history.

(56) References Cited

U.S. PATENT DOCUMENTS 3,555,776 A * 1/1971 Nigrelli et al. ..... 53/580
3,771,282 A * 11/1973 Flanagan ..... 53/574
3,778,959 A 12/1973 Langen et al.
3,956,868 A 5/1976 Ganz et al.
3,986,319 A * 10/1976 Puskarz et al. ..... 53/447
4,250,693 A * 2/1981 Andersson ..... 53/543
4,566,248 A 1/1986 Cooley
4,651,500 A * 3/1987 Chaffey ..... 53/204
4,693,055 A 9/1987 Olsen, Jr. et al.
4,756,139 A 7/1988 LeBras
4,970,843 A 11/1990 Louret et al.
5,038,549 A * 8/1991 Nordstrom ..... 53/447
5,052,544 A 10/1991 Anderson
5,214,904 A 6/1993 DePoint et al.
5,295,623 A * 3/1994 Bacques et al. ..... 229/109
5,501,064 A 3/1996 Ingram et al.
5,502,950 A 4/1996 Moncrief et al.
5,706,633 A 1/1998 Moncrief et al.
5,771,658 A 6/1998 Olson et al.
5,775,067 A 7/1998 Hawley
5,791,124 A * 8/1998 Spatafora ..... 53/456
6,058,679 A * 5/2000 Ziegler et al. ..... 53/448
6,105,338 A 8/2000 Kalany et al.
6,279,301 B1 * 8/2001 Corniani et al. ..... 53/458
6,591,587 B2 * 7/2003 Salm et al. ..... 53/461

* cited by examiner

*Primary Examiner*—Rinaldi I. Rada
*Assistant Examiner*—Paul Durand
(74) *Attorney, Agent, or Firm*—Womble Carlyle Sandridge & Rice, PLLC

(57) ABSTRACT

A continuous motion packaging system for packaging a series of articles in cartons as the cartons are moved along a carton conveyor. A series of selector wedges engage and form groups of articles received on the cartons, which are folded or wrapped about the articles as the cartons are moved forwardly along a packaging path.

9 Claims, 6 Drawing Sheets

CONTINUOUS MOTION PACKAGING SYSTEM

FIELD OF THE INVENTION

The present invention generally relates to cartons and other containers for packaging articles therein, and in particular, to a system for packaging various types of articles in cartons folded about groups of products in a substantially continuous motion process.

BACKGROUND OF THE INVENTION

In the packaging of products such as bottles, cans, pouches or other similar articles, it is common for such products to be packaged in paperboard cartons, such as to form twelve packs, twenty-four packs, or other similar package configurations. Such cartons can be fed into a packaging machine and wrapped about the products or articles being packaged, with the lower or bottom edges of the cartons folded under and either glued or locked together by the engagement of locking tabs with locking recesses formed therein. Alternatively, for packaging selected groups of products, such as twelve packs of cans or bottles, or for packaging other larger and/or irregularly shaped articles, such as frozen pizzas, juice pouches, etc., the cartons typically can be formed into pre-glued sleeves having open ends. These pre-glued sleeves generally are pulled from a stack or supply, opened, and fed into a packaging machine. The products then will be inserted, typically through one end of the sleeve, and the sleeve ends folded and glued shut.

One drawback of utilizing cartons into the pre-glued sleeves for product packaging applications, however, is that such pre-formed sleeves typically are more expensive to produce than conventional stamped or die cut wrapped carton sheets. After stamping or cutting, the carton blanks must be folded and their side edges glued together to form the carton sleeves, which accordingly results in increased costs from a materials and manufacturing standpoint, due to the additional glue required to form the sleeves, and in the need for additional folding and gluing equipment. Further, since the carton sleeves are formed by the folding over of the carton blank material, the carton sleeves generally are thicker than single sheet die cut blanks, and also need to be shipped in cases. As a result, shipping such carton sleeves in cases typically takes up a significantly greater amount of space when stacked on pallets for transportation and storage. This can require additional material handling to arrange and stack the cartons in cases, which, with the cost of the case, further increases the costs of manufacture thereof. Conversely, flat blank cartons can be stacked directly on pallets, eliminating the need for pre-gluing the sleeves or packing of the cartons in cases for transport. However, applying or wrapping such flat blank cartons about products typically can require more precision in the handling, folding, and tucking of the carton panels and locking mechanisms or flaps during formation of the cartons about the products, thus, slowing production rates.

Accordingly, it can be seen that a need exists for a system and method for packaging various types of products or articles in a series of cartons that addresses the foregoing and other related and unrelated problems in the art.

SUMMARY OF THE INVENTION

Briefly described, the present invention generally relates to a continuous motion packaging system for packaging groups of articles within a series of cartons, typically with the cartons being substantially wrapped or formed about the articles. The packaging system of the present invention generally includes an article infeed conveyor, along which a series of articles such as bottles, cans, boxes or other similar products are conveyed along an article infeed path. The articles are moved along a series of spaced lanes, which direct the articles toward a loading position along an adjacent carton conveyor.

The carton conveyor generally includes a series of selector wedges that are spaced apart so as to define flights or carton receiving areas therebetween. Cartons are received within each of the flights and are transported along a packaging path or carton path of travel. Each of the cartons typically is a flat blank or wrap-style carton adapted to be folded or wrapped about a series of articles to form an article or product package, although it will be understood that other types of cartons can be used according to the principles of the present invention.

As the articles move along their article infeed path toward the loading position, the selector wedges engage and separate the articles to form article groups received on the base panels of the cartons within the flights of the carton conveyor. As the cartons continue along their packaging path with a selected group of articles received thereon, top and end panels of the cartons are engaged by guiding or folding mechanisms that fold or urge the end and top panels of the cartons toward the group of articles thereon. At approximately the same time, one or more gusset tucking fingers arranged along the upstream end and/or downstream sides of the selector wedges can be reciprocated or extended outwardly from the selector wedges toward an engaging position so as to contact and urge or tuck gusset portions of the cartons inwardly. Tucking of the gussets helps cause the side panels of the cartons to fold likewise inwardly against the groups of articles.

The number and arrangement of the gusset tucking fingers can be varied as needed, depending upon the size and/or configuration of the cartons being formed or wrapped about the groups of articles. For example, the number of gusset tucking fingers and/or their spacing along the selector wedges, can be varied to enable packaging four packs, six packs, eight packs or other arrangements of articles as desired. The gusset tucking fingers further can be reciprocated between their extended, engaging position and retracted, non-engaging position by one or more drive shafts on which the gusset tucking fingers are mounted, with the ends of the drive shaft being connected to and rotated by a drive mechanism attached to each selector wedge. In one embodiment, the drive mechanism can include a cam arm having a cam follower attached thereto. The cam follower can engage and move along a cam track positioned adjacent the carton conveyor so as to cause rotation of the drive shafts, which in turn reciprocates the gusset tucking fingers between their engaging and non-engaging positions.

The end and top panels of the cartons typically are folded or wrapped about the group of articles received within each flight, and secured, such as by the application of adhesive or engagement of locking mechanisms such as locking tabs or other retention features to form a completed, enclosed product or article package. Thereafter, the packages can be transferred to discharge conveyor for transport away from the packaging system.

Various objects, features and advantages of the present invention will become apparent to those skilled in the art upon a review of the following detailed description when taken in conjunction with the accompanying drawings.

DETAILED DESCRIPTION

Figure 1:
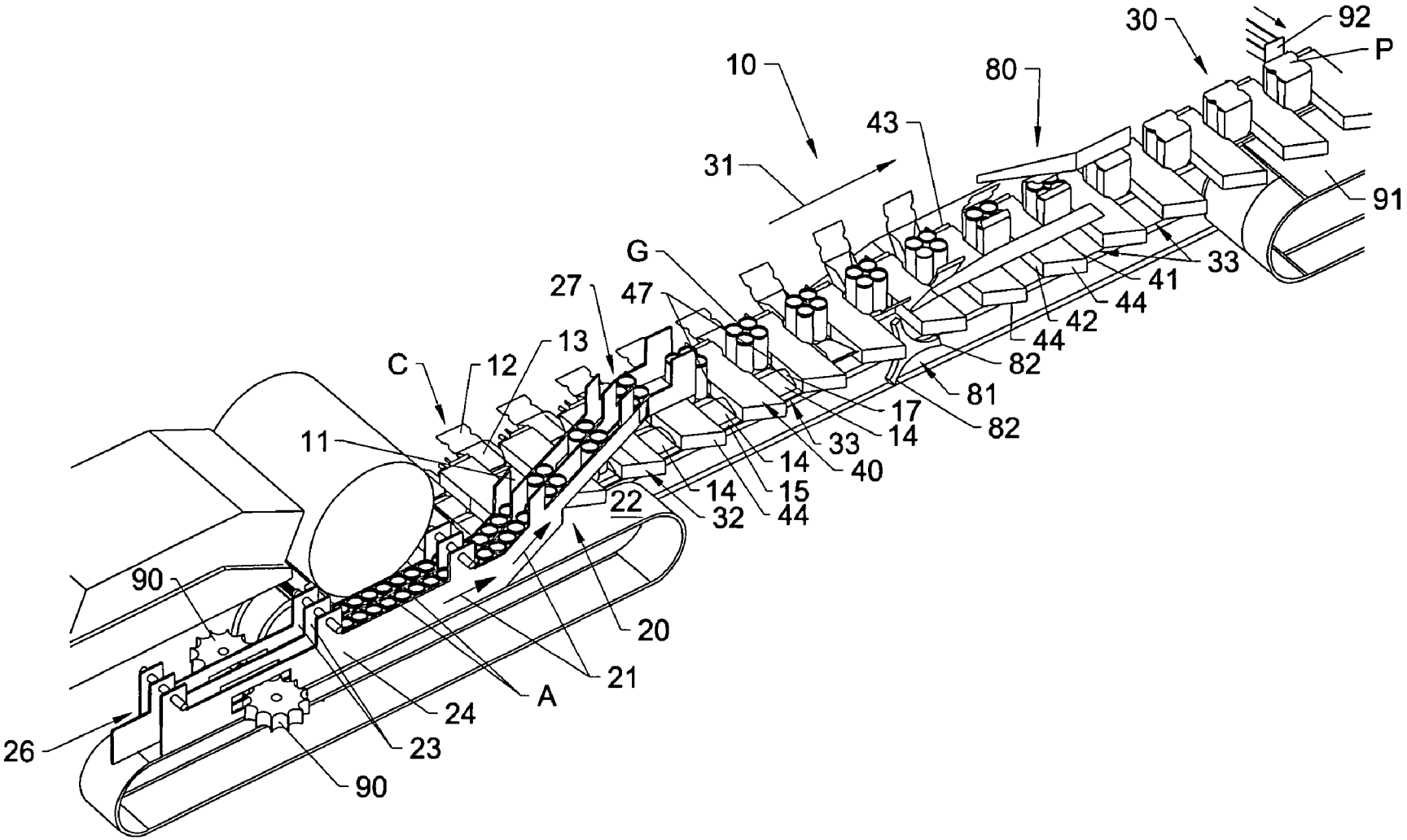
FIG. 1 is a perspective illustration of an example embodiment of the continuous motion packaging system of the present invention.

Referring now in greater detail to the drawings in which like numerals indicate like parts throughout the several views, FIGS. 1-4 generally illustrate one example embodiment of a continuous motion packaging system 10 according to the principles of the present invention. While the present invention is generally illustrated in FIGS. 1-4B, as packaging a series of cans, it will be understood by those skilled in the art that various other products or articles A such as bottles, boxes, or other, similar products can be wrapped or otherwise packaged in cartons C moving through the continuous motion packaging system 10 of the present invention. The cartons C typically will comprise flat blank, wrap style cartons that are designed to fold or be otherwise wrapped about a series of articles received on a bottom or base panel 11 of each carton. The cartons will each include base panel 11, a first or main top panel 12, end panels 13 and 14, and a second top panel 15, which can be folded into an overlying relationship and can be secured together through the use of adhesives or other retention elements such as locking tabs that fit within mating locking recesses to form a completed carton or product package. The cartons further will include side panels 16 with gussets 17 typically formed between the side and end panels, which side panels will fold over to cover a UPC symbol and to enclose, at least partially, the sides of the articles contained therein.

Figure 2:
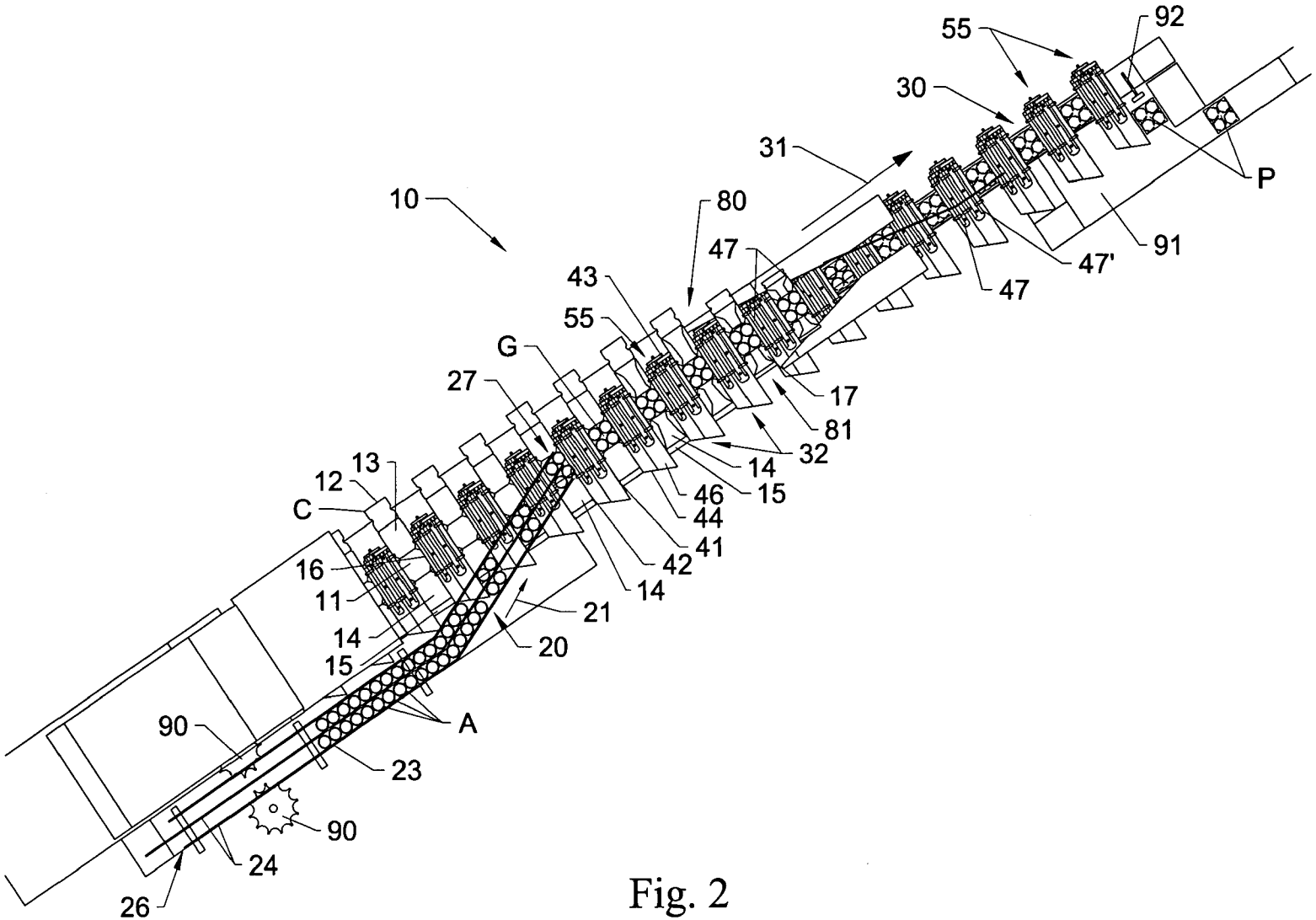
FIG. 2 is a plan view of the continuous motion packaging system of FIG. 1.

As illustrated in FIGS. 1 and 2, the packaging system 10 of the present invention generally will include an article infeed conveyor 20 transporting a series of articles or products A along an article infeed path, indicated by arrows 21. The articles typically will be conveyed along an upper surface or belt 22 of the article infeed conveyor 20 in discrete lines or lanes 23 defined by lane guides 24 as the articles enter the packaging system 10 at an upstream end 26 thereof. The lane guides 24 help maintain the articles in their lanes and redirect the lines of articles toward a loading position indicated at 27 in FIGS. 1-3.

A carton conveyor 30 extends along a carton path of travel or packaging path, indicated by arrow 31, adjacent the article infeed conveyor 20. The carton conveyor conveys the cartons along their path of travel 31 through the loading position 27, at which groups of articles G are loaded onto the bottom or base panels 11 of the cartons. The carton conveyor 30 generally includes a series of spaced selector wedges 32 that define a series of flights or receptacles 33 in which the cartons C are received. As generally illustrated in FIGS. 1-4B, the cartons C are generally received within the flights 33 of the carton conveyor 30 with their base panels 11 lying flat and positioned between a pair of selector wedges, and with the lower side panels 16 of each of the cartons typically being folded upwardly with respect to the base panels.

As generally illustrated in FIGS. 1, 4A-4B, and 5, each of the selector wedges 32 will include a substantially rectangularly shaped body 40 having upstream and downstream side walls 41 and 42, a first or rear end wall 43, a second or front end wall 44, which generally has a slanted or angled configuration sloping inwardly from the upstream side wall 41 toward the downstream side wall 42, and a flat top section or wall 46. The body 40 of each selector wedge generally is formed from a plastic material and can be formed in varying sizes, depending upon the size or configuration of the product packages to be formed. For example, varying sized selector wedges can be used for the packaging of four packs, six packs, or other size product packages. The selector wedges further can be releasably mounted to the carton conveyor to enable quick and easy change-out or reconfiguration of the carton conveyor as needed for running different size or style packages.

As the selector wedges are conveyed by the carton conveyor 30 along the carton path of travel 31, the selector wedges will pass beneath a portion of the lane guides 24 (FIG. 1), upstream from the loading position 27 of the articles A and into engagement with the lines or articles moving along the product lanes 23. As the selector wedges engage the lines of articles moving along the product lanes 23, they will separate and form the desired size article groups G on the base panels 11 of each of the cartons C within the carton flights of the carton conveyor. While groups of four articles are illustrated as being formed in the figures, groups of fewer or more articles (i.e., 2-packs, 6-packs, etc.) also can be formed as desired.

Figure 4A:
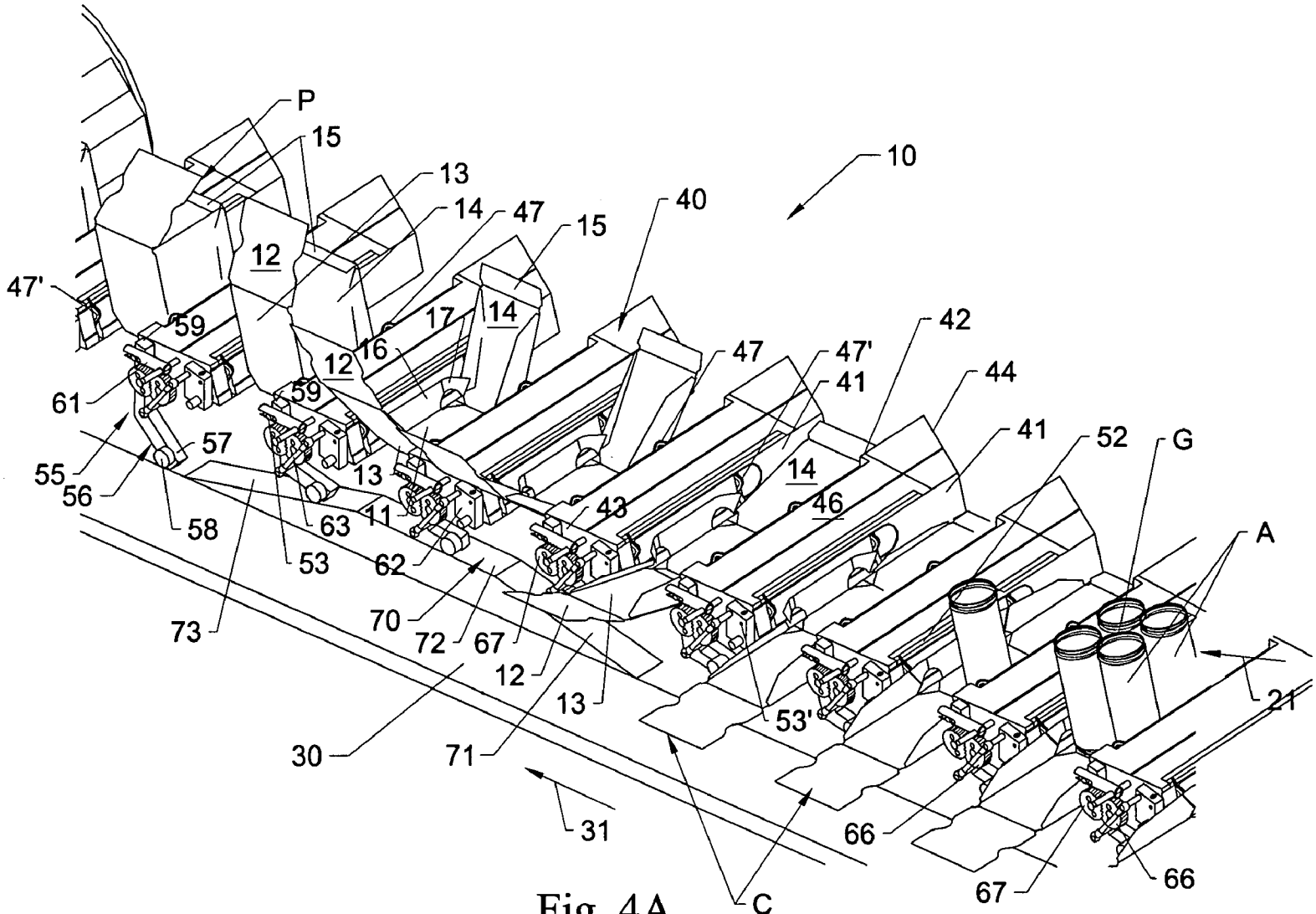
FIGS. 4A-4B are perspective views illustrating the packaging operation with portions of the selector wedges shown in partial cross-section so as to illustrate the operation of the gusset tucking fingers during a wrapping operation.
Figure 4B:
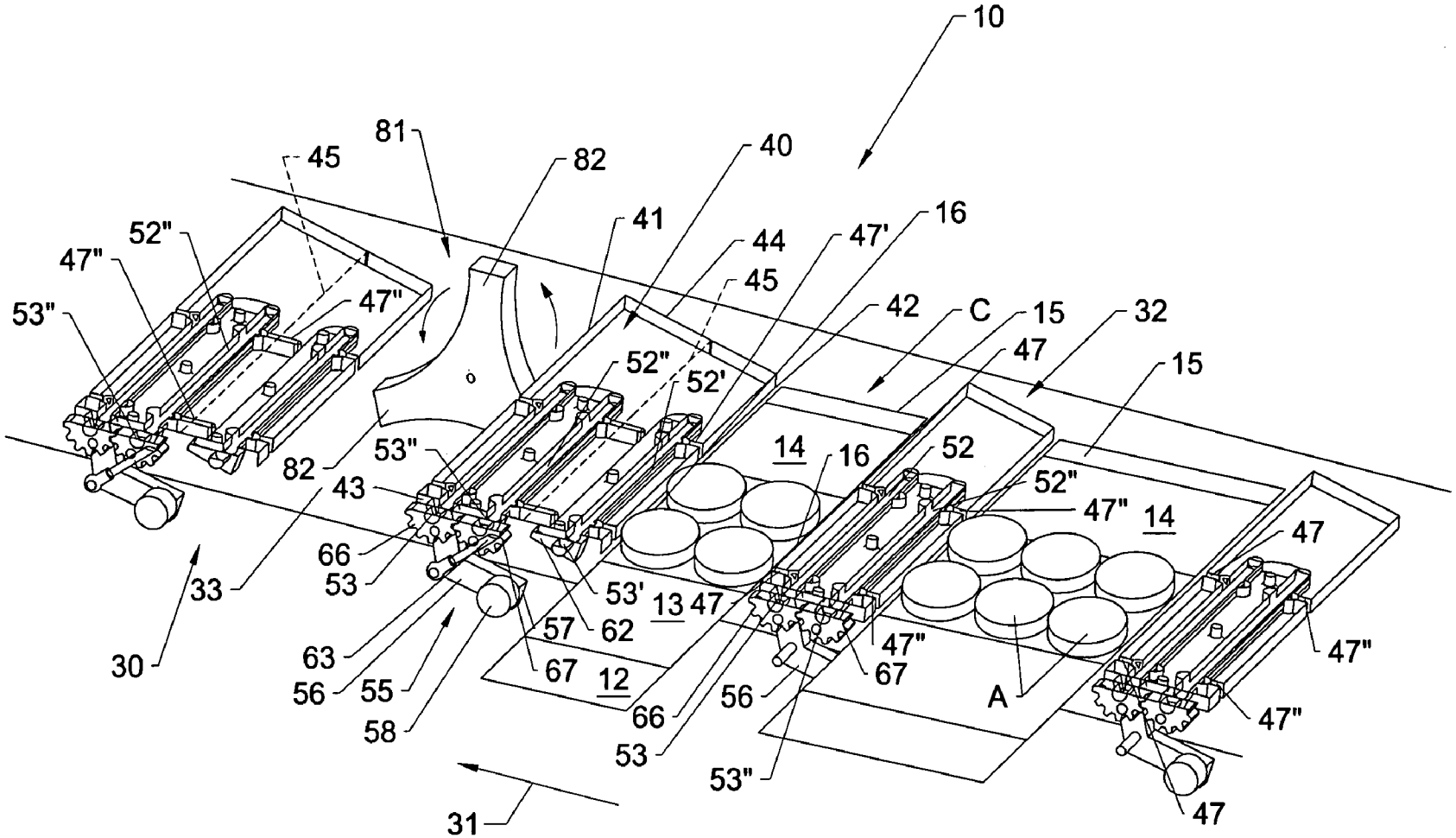
Figure 5:
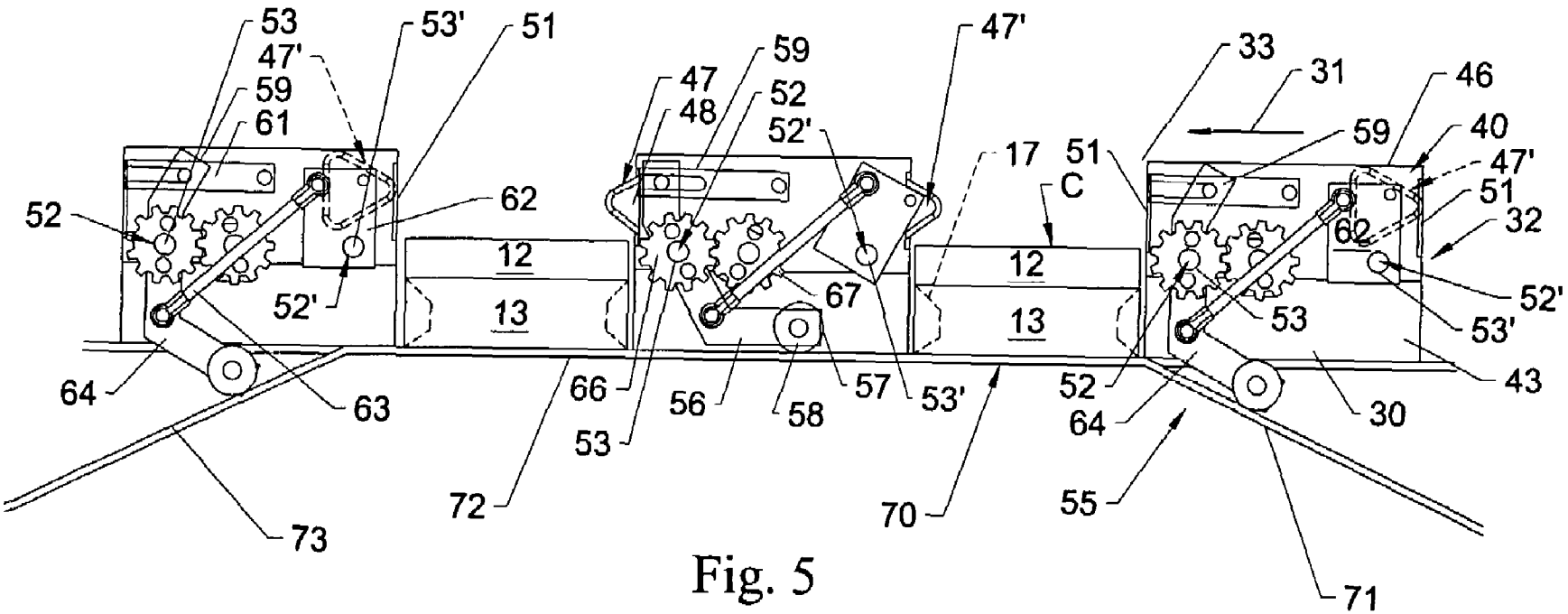
FIG. 5 is a side elevational view, schematically illustrating the operation of the gusset tucking fingers of the selector wedges of the packaging system of the present invention.

As illustrated in FIGS. 4A-5, a series of gusset tucking fingers 47 are positioned at spaced locations adjacent the upstream and downstream side walls 41 and 42, respectively, of each selector wedge 32. Each of the gusset tucking fingers can include a triangular, rectangular, or substantially square shaped body 48, and typically is formed from a plastic or similar rigid, non-stick material. Each gusset tucking finger further includes a projecting edge or rounded corner portion 49 adapted to engage and urge the gussets of the carton C inwardly so as to cause the gussets to be tucked as the top and end panels 12-15 of the cartons are folded upwardly and wrapped about the groups of articles contained on the cartons C, as indicated in FIGS. 4A-5. The gusset tucking fingers 47 are received and reciprocate through slots or openings 51 (FIG. 5) formed in the upstream and downstream walls 41 and 42 of each selector wedge 32. The gusset tucking fingers are reciprocated between an extended, engaging position in contact with and the gussets for tucking the gussets as the carton panels are wrapped about their article groups, and a non-engaging position, retracted within the body 40 of their selector wedge 32 (as indicated at dashed lines 47' in FIG. 5) as the folding and closure of the carton panels about the article groups is completed.

Figure 3:
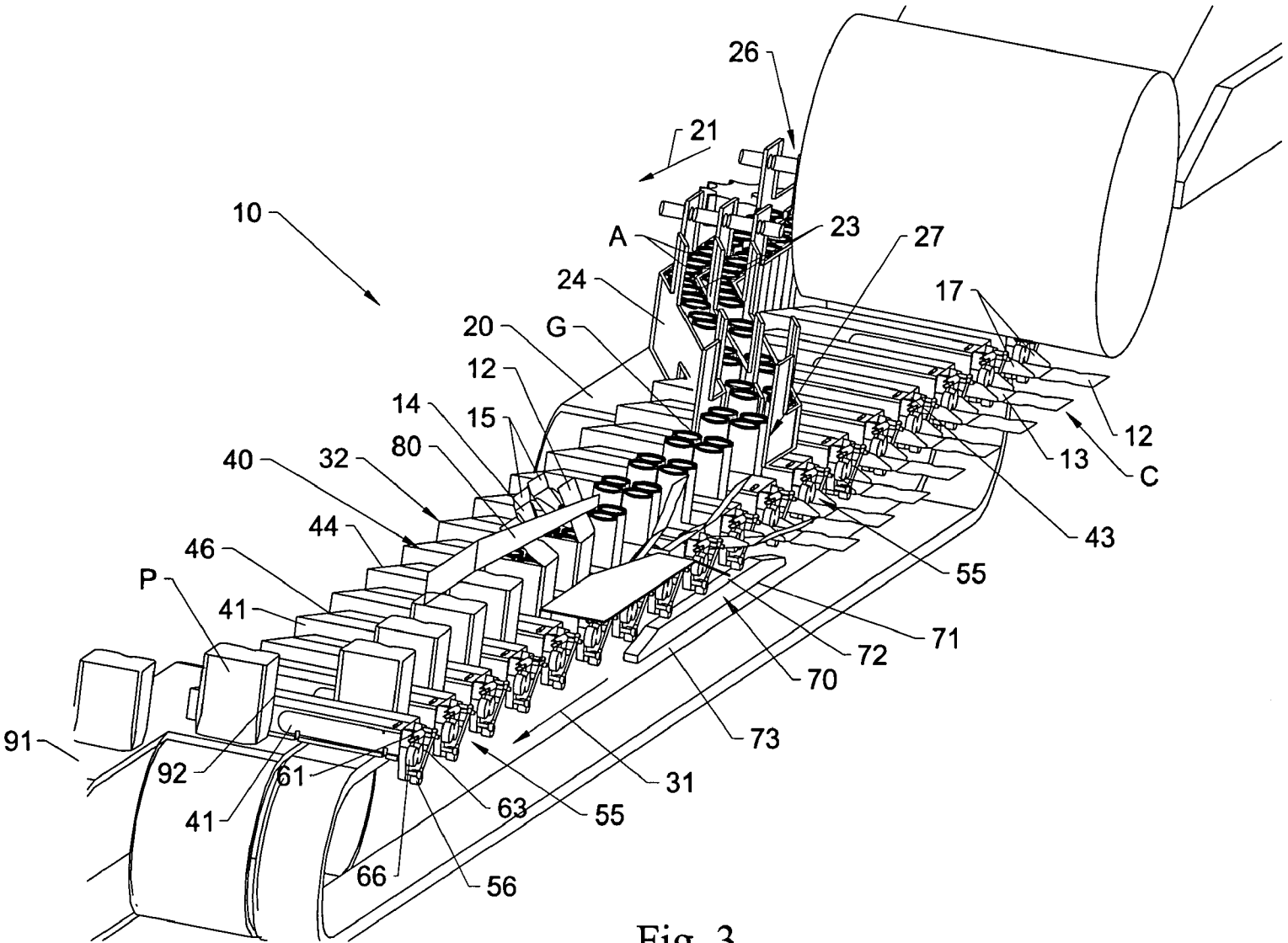
FIG. 3 is a perspective view illustrating of the loading and wrapping operations of the continuous motion packaging system of FIG. 1.

As further illustrated in FIGS. 4A-4B, each of the gusset tucking fingers generally is mounted along a drive shaft or pivot rod 52 that extends at least partially along the length of the body 40 of each selector wedge 32. The proximal or free ends 53 of the drive shafts 52 of each set of gusset tucking fingers 47 generally are extended through the rear end wall 43 of each selector wedge and connect the gusset tucking fingers 47 to a drive mechanism 55 for driving the reciprocating motion of the gusset tucking fingers between their extended and retracted positions. The drive mechanism 55, in the embodiment illustrated in FIGS. 3, 4A-4B, and 5, can include a cam arm 56 rotatably mounted to the rear end wall 43 of each selector wedge 32. The cam arm 56 generally is a substantially L-shaped member including a first or lower portion 57 to which a cam follower 58 is mounted, and a second or upper end 59. A tension spring anchor 61 is mounted adjacent the upper end 59 of each cam arm 56 and is attached thereto so as to apply a tension force, so as to bias the cam arm 56 about drive shaft 52 toward a lowered position for maintaining the gusset tucking fingers in a retracted, non-engaging position inside the selector wedges.

As indicated in FIG. 5, a support or pivot block 62 is attached to the free end 53' of the drive shaft 52' for the gusset tucking fingers 47' along the downstream side of each selector wedge. A connector strut or shaft 63 is attached to an upper rear corner of the support block 62 and to an intermediate portion 64 of the cam arm 56. Thus, as the lower end 57 of the cam arm 56 is rotated upwardly, the strut 63 will urge the support block 62 forwardly so as to cause the downstream gusset tucking fingers 47' to be extended to their engaging position, while at the same time, the upper end 59 of the cam arm 56 is moved forwardly so as to cause the upstream gusset tucking fingers 47 to be moved to their engaging position for engaging and tucking the gussets of the adjacent, cartons as indicated in FIG. 5. A pair of gears 66 and 67 are mounted in an intermeshing arrangement along the cam arm 56, attached to the ends of the drive shafts extending along each selector wedge.

As further illustrated in FIGS. 3-5, a cam track 70 is mounted along the far side of the carton conveyor 30, positioned upstream from the loading position 27. The cam track includes an upstream section 71 that extends at an upwardly sloping angle, a substantially horizontally extending intermediate section 72, and a downwardly sloping downstream section 73. The cam track is positioned so as to be engaged by the cam rollers 58 of the cam arms 56 of each of the selector wedges 32. As the cam rollers move along the upwardly sloping and horizontally oriented cam surfaces 71 and 72 of the cam tracks 70, the cam arm is pivoted and rotated forwardly, causing the gusset tucking fingers 47 and 47' along the upstream and downstream sides, respectively, of each of the selector wedges to be moved to their extended, engaging positions, to tuck in the gussets of the cartons at the start of the folding or wrapping operation. Thereafter, as the cam roller is moved along the downwardly sloping cam surface 73, the cam arm is biased rearwardly and downwardly by the tension spring 61 so as to cause the gusset tucking fingers to be retracted back into their selector wedges.

The number and spacing of gusset tucking fingers further can be varied depending upon the size or configuration of the package being formed. For example, selector wedges can include pairs of gusset tucking fingers arranged at spacings to form four-packs of cans such as illustrated in the present embodiment, or arranged at spacings or positions adapted for use in forming six-packs or larger product packages. As shown in FIG. 4B, the body 40 of each selector wedge can be formed in sections, indicated at 40' and 40", which sections can be detached along mating edges, shown at line 45 in FIG. 4B, for enabling the packaging system 10 to run 6 packs or larger product packages. The selector wedges 32 thus can include a third drive shaft 52" to which a third, intermediate set of gusset tucking fingers 47" can be attached. The distal end 53 of drive shaft 52 is attached to drive gear 66, while the end 53" of drive shaft 52" is attached to drive gear 67. Consequently, as the cam roller 58 moves along cam track 70, causing cam arm 56 to pivot upwardly and rotate drive shaft 52, the meshing engagement of drive gears 66 and 67 similarly causes the rotation of drive shaft 52". As a result, gusset tucking fingers 47 and 47" are caused to reciprocate between their engaging and non-engaging positions for tucking the gussets of 6-pack or larger size cartons.

As illustrated in FIGS. 1 and 3, a plow or turning plate 80 is mounted along the opposite side of the carton conveyor 30 adjacent and extending downstream from the cam track 70. The plow or turning plate 80 generally is an elongated plate that curves upwardly and over the path of travel 31 of the cartons as the cartons are moved along the carton conveyor. Top and end panels 12 and 13 of each carton thus are moved and folded upwardly and over the group of articles on the base panel 11 of each carton as the top and end panels are moved along the plow or turning plate 80. As further illustrated in FIG. 1, a folding wheel 81 is mounted along the opposite, loading side of the carton conveyor downstream from the loading position of the articles. The folding wheel 81 generally includes a series of radially projecting arms 82 that engage and urge end panels 14 of each carton C upwardly toward a folded position against the group of articles contained on the base panel of the carton. The folding wheel 81 generally is rotated as the cartons pass thereover so that the arms 82 of the folding wheel are rotated to a lowered position below the bottom surfaces of the selector wedges to avoid interference with the selector wedges as the selector wedges are passed over the folding wheel.

In operation of the packaging system 10 of the present invention, as shown in FIGS. 1 and 2, the articles such as bottles, cans, or similar products will be conveyed along a series of product lanes 23 by the article infeed conveyor 20. Metering wheels 90 can be provided at the upstream or inlet end of the packaging system, typically being mounted on both sides of the article infeed conveyor, for controlling the infeed of the articles as they move along their article infeed path 21 into the packaging system 10. The articles thereafter are guided along their article infeed path toward a loading position, indicated at 27.

As the articles approach their loading position, a series of selector wedges mounted along the carton conveyor 30 engage and select or separate the articles into article groups G. The selector wedges urge the groups of articles along the end portions of the lane guides and into a loading position wherein each of the article groups are received on a base panel 11 of a carton C positioned in each flight 33 of the carton conveyor 30.

As the cartons, with the groups of articles thereon, continue along their path of travel, indicated by arrows 31, a cam follower 58 (FIGS. 3-5) of each selector wedge engages and moves along the upwardly sloping and horizontally oriented cam surfaces 71 and 72 of cam track 70 so as to cause their cam arms 56 to be pivoted forwardly and upwardly. As a result, gusset tucking fingers 47 and 47' positioned along the upstream and downstream sides of the selector wedges 32 are moved to their outwardly extending, engaging positions. As the gusset tucking fingers are moved to their fully extended engaging positions, they tend to contact gusset portions 17 of the cartons C so as to urge the gussets to fold upwardly and inwardly toward the group of articles contained on the base panels of such cartons.

As the gussets are urged inwardly, the upstream and downstream side panels of the cartons likewise are caused to fold inwardly, while the natural tendency of the end panels 13 and 14 of the cartons is to lift or begin folding upwardly toward the articles as well. Thereafter, end panel 13 is engaged by turning plate 80, while end panel 14 is engaged by a rotating arm 82 of folding wheel 81, so as to cause the end panels 12 and 14 to be folded upwardly, and then plowed above the selector wedges using guides. The first or primary top panel 12 of each carton further is folded over and into engagement with second top panel 15 as it is moved further along the turning plate 80 by the continued forward movement of the carton conveyor. As the end panels and top panel are being folded about the article group formed on each carton, the cam follower of the selector wedges will be moved along the downwardly sloping downstream section 73 of cam track 70, which causes the gusset tucking fingers to be retracted to their non-engaging positions within the body of each of the selector wedges.

After the top and end panels of the cartons have been folded upwardly about the article groups toward a closed position, the top panels 12, 15 can be secured by the application of adhesives, or the engagement of retention elements such as locking tabs and recesses formed along the top and end panels to thus form a completed product package. The completed article or product packages are thereafter transferred to a discharge conveyor 91 (FIGS. 1 and 2) such as by a pusher or similar transfer mechanism 92 moving in timed relation with the forward movement of the cartons along the carton conveyor. The discharge conveyor thereafter will transfer the completed cartons away from the packaging system 10 of the present invention for further packaging and/or storage.

The present invention thus allows and enables the packaging of smaller packages or varying size articles in a flat blank carton to provide for masking of UPC or other graphic materials and as needed, while still providing adequate and simple product retention without requiring the use of larger, more complex packaging equipment to provide for increased packaging production rates. The system of the present invention further enables the quick and easy change-out of components for forming packages of varying sizes and/or configurations to provide for greater flexibility and versatility of the packaging system.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A method of packaging articles, comprising:

moving a series of articles along an article infeed path;

moving a series of cartons received on a carton conveyor along a packaging path adjacent the article infeed path;

directing the articles toward a loading position along the packaging path;

engaging the articles with a series of selector wedges as the articles approach their loading position so as to form article groups;

depositing each of the article groups on a carton contained within a flight of the carton conveyor;

urging a portion of each carton over the groups of articles loaded thereon;

as the cartons are urged over the groups of articles, engaging and tucking gussets of the cartons inwardly with gusset tucking fingers arranged along the selector wedges; and moving a cam follower along a cam track as the cartons are moved along their carton path of travel, and in response, reciprocating the gusset tucking fingers toward and away from engagement with the gussets of the cartons to cause side panels of the cartons to be folded about the groups of articles.

2. The method of claim 1 and further comprising closing a top panel of each carton about each article group received thereon to form an article package.

3. The method of claim 1 and wherein urging a portion of each carton over the group of articles loaded thereon comprises folding opposing end panels of each carton upwardly and inwardly toward the group of articles and folding a top panel downwardly toward the group of articles.

4. The method of claim 3 and further comprising engaging one of the end panels with the top panel of each carton as the top and end panels are folded toward the group of articles to close the carton thereabout.

5. A system for packaging articles within a series of cartons, comprising:

an article infeed conveyor for feeding a series of articles along a first path of travel;

a carton conveyor having a series of flights in which the cartons are received and conveyed along a second path of travel;

a series of selector wedges mounted in spaced series along said carton conveyor and defining said flights therebetween, said selector wedges adapted to engage and separate the series of articles into article groups received within said flights and each including at least one gusset tucking finger moveable between a non-engaging position and an engaging position projecting into one of said flights so as to engage and tuck a gusset of a carton within said one of said flight as the carton is folded about a group of articles therein;

a guide mechanism mounted along said carton conveyor and adapted to cause the cartons to be folded about the groups of articles in said flights; and a drive mechanism mounted to each selector wedge and linked to said at least one gusset tucking finger for reciprocating said at least one gusset tucking finger into and out of engagement with the gusset of the carton;

wherein said drive mechanism comprises a drive shaft extending through each of said selector wedges and connected to said at least one gusset tucking finger, and a cam arm for causing rotation of said drive shaft to reciprocate said at least one gusset tucking finger between is engaging and non-engaging positions.

6. A system for packaging articles within a series of cartons, comprising:

an article infeed conveyor for feeding a series of articles along a first path of travel;

a carton conveyor having a series of flights in which the cartons are received and conveyed along a second path of travel;

a series of selector wedges mounted in spaced series along said carton conveyor and defining said flights therebetween, said selector wedges adapted to engage and separate the series of articles into article groups received within said flights and each including at least one gusset tucking finger moveable between a non-engaging position and an engaging position projecting into one of said flights so as to engage and tuck a gusset of a carton within said one of said flight as the carton is folded about a group of articles therein; and a guide mechanism mounted along said carton conveyor and adapted to cause the cartons to be folded about the groups of articles in said flights, said guide mechanism comprising a folding wheel positioned along said second path of travel and having a series of arms rotated into engagement with an end panel of each carton as each carton is moved along its path of travel so that the end panel is guided upwardly toward a group of articles received on the carton, after which said arms are further rotated to a lowered position to enable said selector wedges to pass thereover.

7. The system of claim 6 and further comprising a series of lane guides extending across said article infeed conveyor for directing the articles in lines toward a loading position along said carton conveyor.

8. A system for packaging articles within a series of cartons, comprising:

an article infeed conveyor for feeding a series of articles along a first path of travel;

a carton conveyor having a series of flights in which the cartons are received and conveyed along a second path of travel;

a series of selector wedges mounted in spaced series along said carton conveyor and defining said flights therebetween, said selector wedges adapted to engage and separate the series of articles into article groups received within said flights and each including at least one gusset tucking finger moveable between a non-engaging position and an engaging position projecting into one of said flights so as to engage and tuck a gusset of a carton within said one of said flight as the carton is folded about a group of articles therein;

a guide mechanism mounted along said carton conveyor and adapted to cause the cartons to be folded about the groups of articles in said flights; and a cam track extending adjacent said carton conveyor, and wherein each of said selector wedges further includes a cam arm linked to said at least one gusset tucking finger and having a cam follower adapted to engage and move along said cam track for moving said at least one gusset tucking finger between its non-engaging position and its engaging position for tucking the gussets of the cartons within the flights as the cartons are wrapped about their article groups.

9. The system of claim 8 and further comprising a pair of drive shafts extending along each of said selector wedges and a series of gusset tucking fingers positioned along opposite sides of each of said selector wedges, said gusset tucking fingers mounted in spaced series along said drive shafts, and wherein said drive shafts are linked to said cam arm for rotating said drive shafts as said cam follower of said cam arm moves along said cam track.

* * * * *